US006193638B1

(12) United States Patent
Barrett

(10) Patent No.: US 6,193,638 B1
(45) Date of Patent: Feb. 27, 2001

(54) PORTABLE GENERAL PURPOSE EXERCISE DEVICE

(76) Inventor: Robert V. Barrett, 3380 Webberville, Williamston, MI (US) 48895

( * ) Notice: Subject to any disclaimer, the term of this patent is extended or adjusted under 35 U.S.C. 154(b) by 0 days.

(21) Appl. No.: 08/787,756

(22) Filed: Jan. 28, 1997

(51) Int. Cl.[7] ..... A63B 21/02

(52) U.S. Cl. ..... 482/128; 482/125; 482/121

(58) Field of Search ..... 422/121, 122, 422/124, 125; 482/121–130

(56) References Cited

U.S. PATENT DOCUMENTS 4,591,150 * 5/1986 Mosher ..... 482/125

5,232,425 * 8/1993 Miller et al. ..... 482/125

* cited by examiner

*Primary Examiner*—Jerome W. Donnelly
(74) *Attorney, Agent, or Firm*—Daniel E. McComb

(57) ABSTRACT

A Portable General Purpose Exercise Device which functions as a small, lightweight, inexpensive exercise device for use by a human being. This device comprises an inner section of handles which is allowed to slide along an outer section of handles. The two sections of handles are predetermined to be shaped and or otherwise configured for gripping and engaging human body parts. A stretchable means for resistance is interconnected between the two handle sections. When the exerciser moves the handle sections relative to one another both pushing and pulling exercises can be preformed on the same unit by varying the choice of handles gripped and the direction of the force exerted on the chosen handle. This allows the many different sized and configured muscle groups in the human body to be exercised.

3 Claims, 4 Drawing Sheets

PORTABLE GENERAL PURPOSE EXERCISE DEVICE

BACKGROUND—FIELD OF THE INVENTION

This invention relates to portable exercise devices that use elastic members to provide resistance.

BACKGROUND DESCRIPTION OF THE PRIOR ART

U.S. Pat. Nos. 5,277,684 or 4,492,375 use a large bulky frame to anchor the elastic members. The mass of the frame in combination with the user's mass is designed to provide a stable anchor point for the elastic member. The exerciser exerts force against the elastic member. When the exerciser exerts sufficient force usually on a handle or lever having the elastic member interconnected between the stationary structure and the handle the elastic member stretches.

U.S. Pat. No. 5,468,205 solves the anchor problem with a device that mounts to a door. Many prior art exercise machines solve the anchor problem with devices where the exerciser pulls two portions of the device apart. These devices suffer from the limitation that the exerciser cannot perform exercises that push against the device. Examples of these include U.S. Pat. Nos. 5,372,566, 4,852,874, 4,540, 173, and 5,397,288. These devices use the hands, feet and the body itself as the anchor point for pulling exercises but they lack the structure to allow reversal of the motion which requires pushing against the device.

U.S Pat. No. 5,399,138 is an example of an exercise device that is designed to exercise specific body parts. Devices of this type are limited and lack general functionality. They allow specific muscles to be exercised but cannot be the basis of a complete fitness program.

OBJECTS AND ADVANTAGES

One objective of this invention is to provide a device that is compact, portable, and lightweight. This exercise device is compact and can be constructed of lightweight plastic or lightweight metals, therefore, it has the advantage of being lightweight and portable.

Another object of this portable exercise device is that it does not require any external circumstance beyond a willing exerciser to function. A willing user can use this machine anywhere. It does not require a specific external anchor point like a door or bed post.

This exercise device is designed to be capable of performing both pushing and pulling exercises. Pushing and pulling exercises can be performed sequentially without and intermediate steps being required by the user. This represents a very significant advantage.

Another objective is that this exercise machine has the capability of supporting a general fitness program that can exercise the major muscle groups of the human body. The multiple handles are deliberately spaced and configured to allow for different ranges of motion. Having multiple sections of handles so that this device can function in opposition, for both pull apart as well as push together exercises, provide this exercise machine with tremendous utility for performing an extremely wide variety of exercises.

Another goal of this portable exercise device is that resistive forces can be varied easily. The exerciser selects different resistive forces by using different strengths, or additional resistance bands. This provides the user with variable resistance forces in a small lightweight exercise machine.

Another object is to allow rotation between the two sections of handles. This provides that handles can be adjusted with respect to one another quickly. Exercises can be preformed with handles slightly rotated to accommodate the exerciser. The handles when rotated to 90 degrees provide yet another completely different configuration. This configuration increases the diversity as to the type of exercises that can be performed. This adjustability provides significant advantage when designing exercises for both sides of the body, for example the right arms, and then the left arms.

Another object of this invention is to benefit handicapped persons confined to a wheel chair. This device has a compact, lightweight, handheld design, which allows a sitting person to exercise the major muscle groups of the upper body.

Another object of this invention is that it be easy and inexpensive to manufacture. This construction of this device lends itself to straight sections. Because of the simplicity of the straight sections and basic components this device is inexpensive to manufacture. One method of manufacture uses commonly available PVC pipe components.

Further objects and advantages of my invention will become apparent from a consideration of the drawings and ensuing description.

DRAWING FIGURES SECTION

LIST OF REFERENCE NUMERALS FOR FIGS. 1 AND 2

Figure 1:
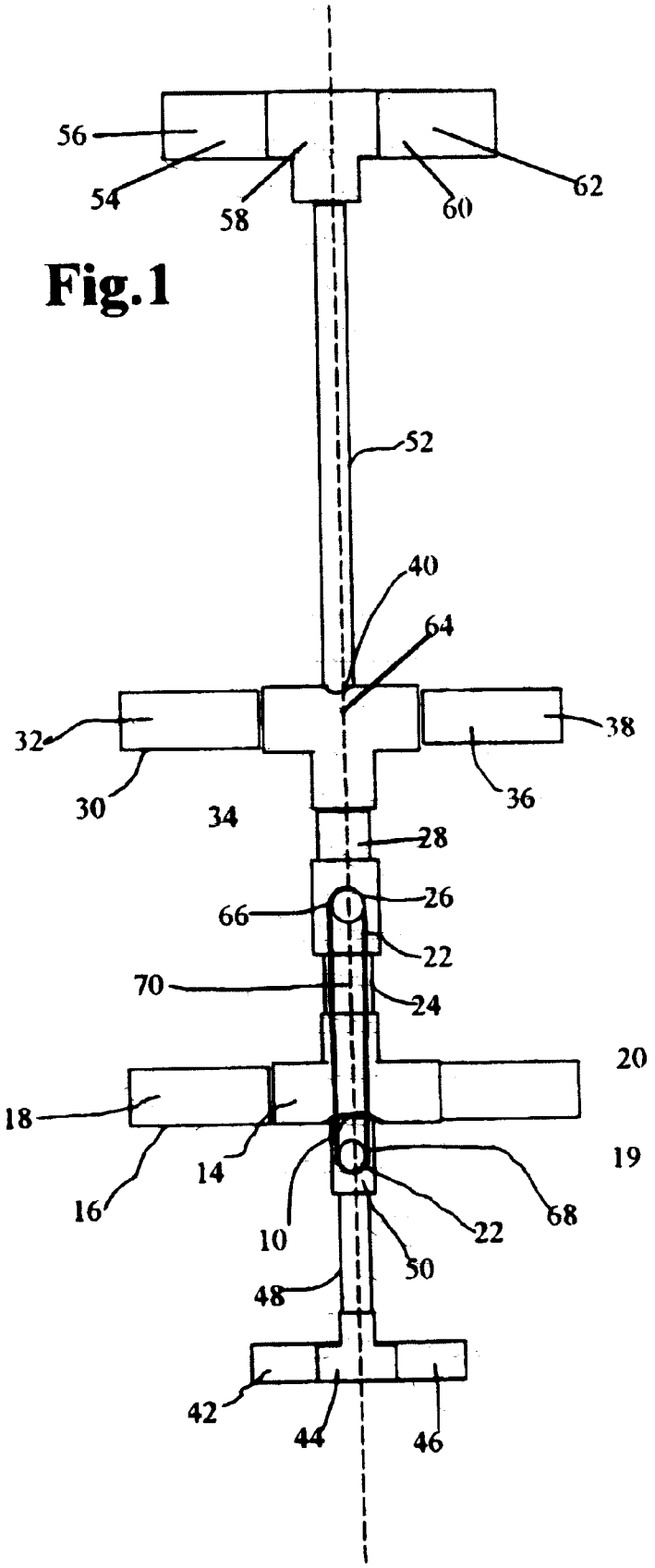
FIG. 1 is a top-side drawing of one method of constructing this portable exercise device.

10 Hole One or entrance hole
14 Three Way Tee Two
16 Handle Bar Three
18 Synthetic Grip One
19 Synthetic Grip Two
20 Handle Bar Four
22 Attachment Point, or means of attachment
24 Pipe section Three
26 Four Way Tee Two
28 Pipe Section Four,
30 Handle Bar Five
32 Synthetic Grip Three
34 Three Way Tee Three,
36 Handle Bar Six
38 Synthetic Grip Four
40 Hole Two or exit hole
42 Handle Bar One
44 Three Way Tee One
46 Handle Bar Two
48 Pipe Section One
50 Four Way Tee One
52 Pipe Section Two
54 Handle Bar Seven
56 Synthetic Grip Five
58 Three Way Tee Four
60 Handle Bar Eight
62 Synthetic Grip Six

64 Resistance Bands
66 First end of resistance bands
68 Second end of Resistance bands
70 Longitudinal axis

LIST OF REFERENCE FOR FIGS. 3 AND 4

102 inner handle section
104 entrance hole
106 exit hole
108 first elongated member
110 two ends of first elongated member
112 additional elongated members
114 midsections of additional elongated members
116 second elongated member
118 two ends of second elongated member
120 means for resistance
122 first resistance end
124 second resistance end
126 first means of attachment
128 second means of attachment
130 outer handle section

DESCRIPTION

Figure 2:
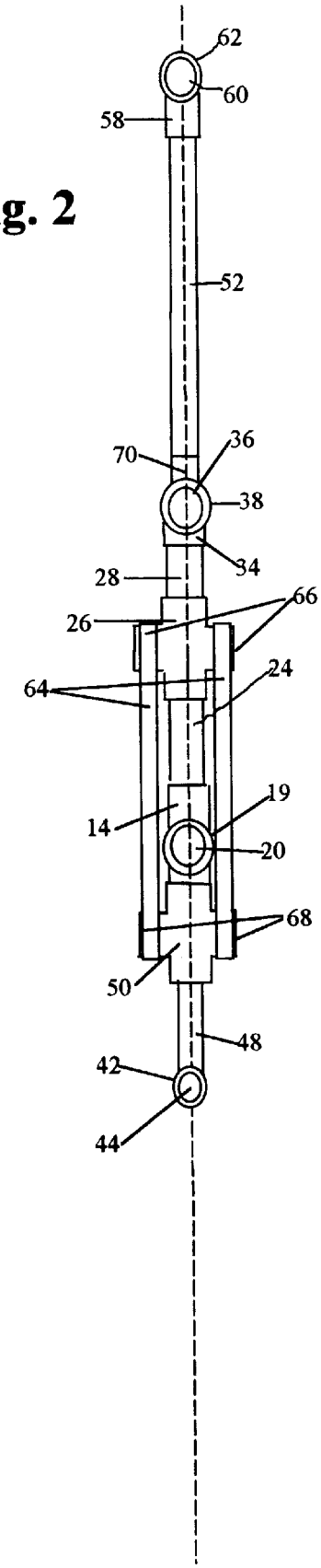
FIG. 2 is a side drawing of one method of construction this portable exercise device.

Showing One Method of Construction FIGS. 1 & 2

FIG. 1 and FIG. 2 show tubular assemblies embodying the present invention. This embodiment of the portable exercise device consists of a inner handle section assembled from parts 14, 16, 18, 19, 20, 24, 26, 28, 30, 32, 34, 36, and 38. A handle (16) in this embodiment which is made from PVC tubing is covered with a synthetic grip (18). Handle (16) is inserted into the three-way tee (14) also made from PVC. The three-way tee (14) and the PVC handle (16) are joined using a suitable adhesive as are all PVC parts in this assembly. A PVC handle (20) covered with a synthetic grip (19) is attached to the three-way tee (14) at a position rotated 180 degrees from and along the same longitudinal axis as defined by handle (16). A hole (10) is drilled opposite the third opening in PVC tee (14). A pipe section (24) in this embodiment made of PVC is inserted and attached using suitable adhesive. The end of pipe section (24), opposite the end attached to three-way tee (14) is similarly attached in one opening of four-way tee (26). Pipe section (28) is attached to four way tee (26) opposite from pipe section (24). Pipe section (28) is then attached to three-way tee (34). A PVC handle (36) covered with a synthetic grip (38) is attached to the three-way tee (34) at a position rotated 180 degrees from and along the same longitudinal axis as defined by handle (30) and synthetic grip (32). A hole (40) is drilled in PVC three-way tee (34). This assembly comprises the inner handle sub-assembly.

A second sub-assembly, is assembled from parts 42, 44, 46, 48, 50, 52, 56, 54, 58 60, 62, PVC handle (42) is attached to three-way tee (44). A PVC handle (46) is attached to the three-way tee (44) at a position rotated 180 degrees from and along the same longitudinal axis as defined by handle (42).

The three-way tee (44) and the PVC handle (42) and PVC handle (44) are joined using a suitable PVC adhesive as are all PVC parts in this sub- assembly. Similarly, PVC pipe (48) is attached to the third opening in three-way tee (44). The end of PVC pipe (48) opposite three way tee (44) is attached to four-way tee (50). At a point 180 degrees from the point where PVC pipe (48) is joined to four-way tee (50) a PVC pipe (52) approximately twenty-two inches long is attached. PVC pipe (52) is then placed through hole (10) in three-way tee (14) and through pipe (24), four-way tee (26), pipe (28), and three way tee (34), and finally through hole (40) in three-way tee (34). After pipe (52) is inserted through the inner handle section it is attached to three-way tee (58). Handle (54) covered with synthetic grip (56) is attached to three-way tee (58). Handle (60) covered with synthetic grip (62) is attached to three-way tee (58) at a point 180 degrees opposite where handle (54) is attached to three-way tee (58).

A resistance band (64) is slipped over one of the protruding ends of four-way tee (50). The resistance band is then stretched and placed over the corresponding end of four-way tee (26). A second resistance is slipped over the remaining protruding end of four-way tee (50) then stretched and placed over the remaining protruding end of four-way tee (26).

A Description of the Main Embodiement

FIGS. 3 & 4

An inner handle section (102) having of an entrance hole (104) and a exit hole (106) is manufactured to provide a passage completely through the inner handle (102). The inner handle section (102) is manufactured to have additional elongated members (112), attached at their midsections to the first elongated member (108). The size, shape, number and orientation of these additional elongated members (112) can vary. The purpose is to provide a method of grasping by the human hand or other body appendages that allow the inner handle to be pushed or pulled by the exerciser. A bike handle grip construction has been shown to be an effective means of gripping but other shapes are not excluded.

An outer handle section (130) is manufactured with a second elongated member (116) which extends into entrance hole (104), through inner handle section (102) and out exit hole (106). The two ends of the second elongated member (116) are designated as two ends of second elongated member (118). Both of the two ends of the second elongated member (118) have additional elongated members (112) attached at their midsections perpendicular to the second elongated member (116) suitable for gripping by a human being. The size, shape, number and orientation of these additional elongated members (112) can vary. The purpose is to provide a method of grasping by the human hand or other body appendages that allow the inner handle to be pushed or pulled by the exerciser. The additional elongated members (112) are manufactured as a fundamental part of the second elongated member. The size, number, shape, and orientation of the additional elongated members (112) can vary as long as they are suitable for manipulation by a human being. One requirement is that additional elongated members (112) attached to second elongated member (116) be located outside of and on each side of the inner handle section (102) which slides and rotates around the second elongated member (116) which is part of the handle section (130). The additional elongated members (112) which are part of the outer handle section (130) must be of sufficient size to contain the inner handle section (102) and prevent it from being removed from the second elongated member (116) once assembly is complete. A means for resistance (120) which has a first end (122) is attached using a first means of attachment (126) to the inner handle section (102). Using a first means of attachment (128) at the second resistance end (124) the means for resistance (120) is attached to the outer handle section (130).

Operation—Main Embodiment

The manner of using the illustrated portable exercise device involves the human user pushing or pulling on the inner or outer handle sets, various sets of handles. The exercise devise translates the pushing or pulling into a resistance by causing the elastic bands to stretch. The amount of resistance is varied by having multiple means for resistance available, as well as, the magnitude of relative motion between the handles. The resistance provided by the exercise machine then works the various muscle groups in the human anatomy. This exercise machine is capable of working on an extremely large number of muscle groups.

Figure 3:
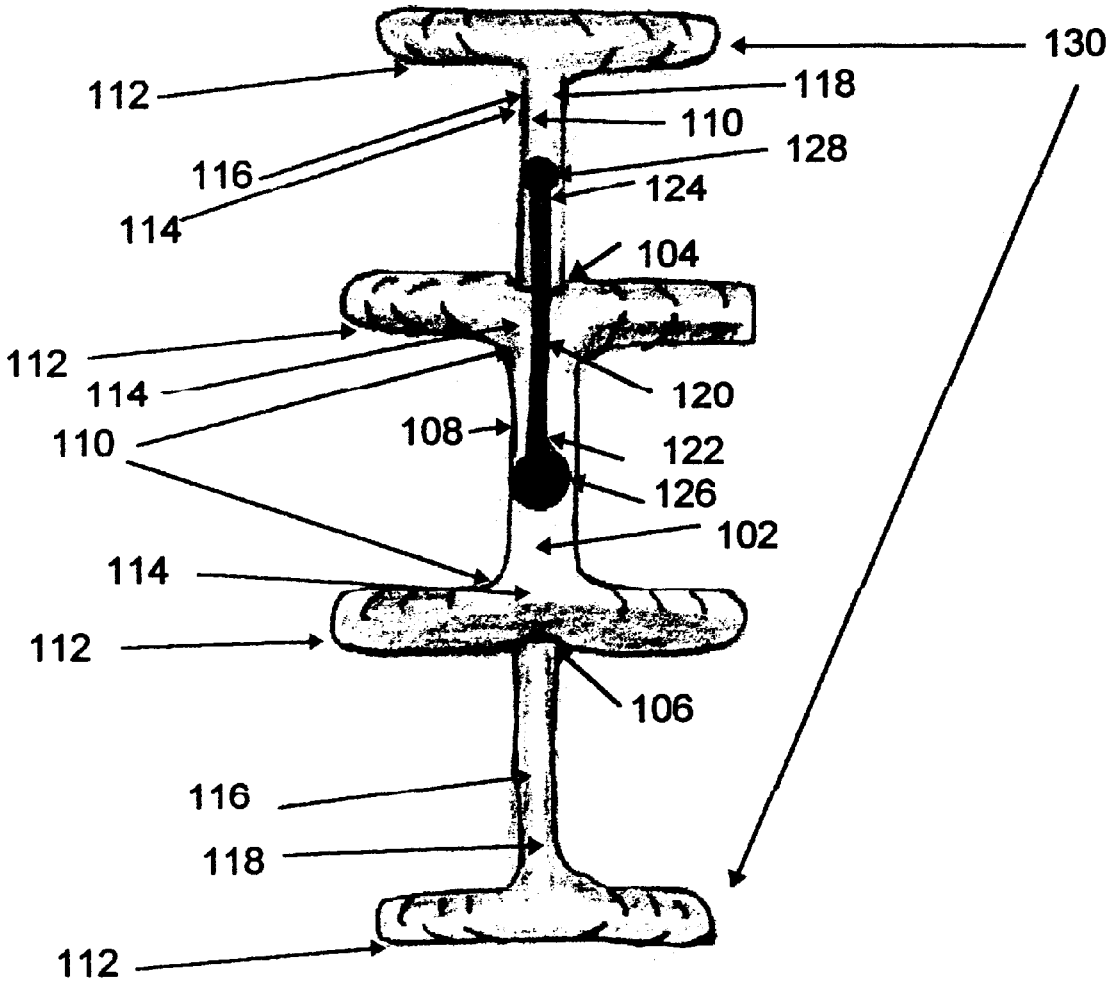
FIG. 3 is a top-side drawing showing the general features of this portable exercise device.
Figure 4:
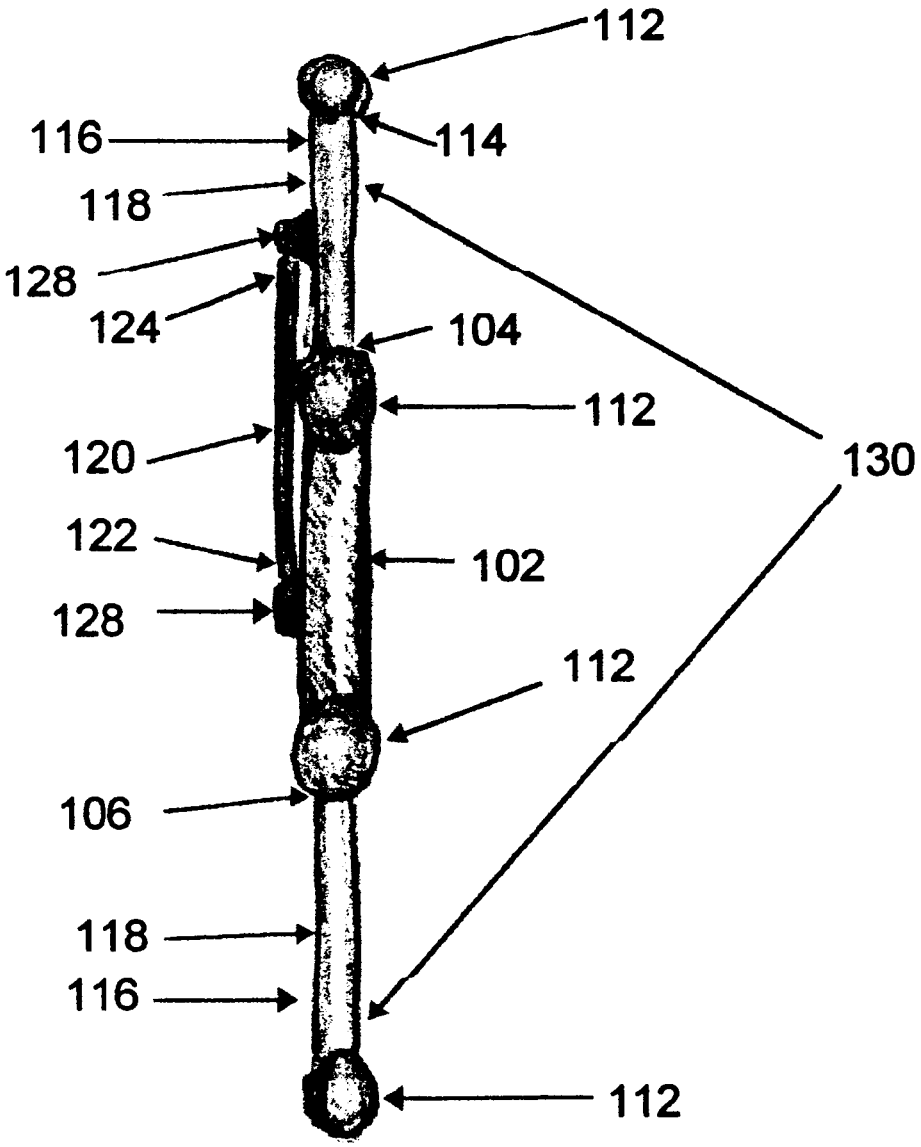
FIG. 4 is a side drawing showing the general features of this portable exercise device.

This machine is designed in a fashion that allows the outer handle section to slide in relation to the inner handle section. This design provides a unique multiplicity of exercise configurations. The handle sections are designed so that both pushing exercises as well as pulling exercises are possible in a small, compact, lightweight device. These exercises can be performed by either a normal or handicapped person sitting or lying down. The inventor has developed for illustrative purposes the following methods of exercising with the Portable General Purpose Exercise Device. However, many other exercise routines could be developed which utilize this device. The device constructed from PVC piping is used to illustrate these exercises, however, they are adaptable to to the general device shown in FIGS. 3 and 4. The relative motions of the inner and outer handle sets remain the same.

This device can be used for the chest area. The user can use this device either standing or setting by holding the device straight out at arms length by grasping handle bars six (36) and handle bar eight (60) with palms facing each other and fingers curled around each respective handle. The user then forces handle bar six (36) and eight (60) together which exercises the chest muscles. As handle bar eight (60) moves toward handle bar six (36) the inner handle section which includes handle bars three (16), four (20), five (30), and six (36) (FIGS. 1 and 2) slides longitudinally along pipe section two (52) of the outer section that includes handles bars one (42), two (46), seven (54) and eight (60). The distance between the four way tees where the elastic bands are attached between the inner and outer sections increases causing the elastic bands to stretch, thus providing the resistance that exercises the chest muscle group.

The user either standing or setting can exercise the shoulder and back. The user holds the device straight out at arms length and grasps handle bars two (46) and six (36). Keeping the arms extended and forcing handles two (46) and six (36) apart increasing the distance between the four way tees attached to the I shaped sub assembly. Since the resistance bands are attached at the four way tees the resistance bands must stretch to allow this relative motion. The resistance provided by the stretching bands provides exercise for the shoulders and back of the user.

Exercising the shoulders and abdominal areas is accomplished in either a standing or sitting. Place handle bar seven (54) and eight (60) across the abdominal area then reach across and gras handle bars three (16) and four (20) with palms toward the floor and fingers curled around handle bars three (16) and four (20). Pull handle bar three (16) and four (20) inward toward the chest. This movement causes the two I section handle sub-assemblies to move relative to each other and stretches the resistance bands.

To exercise the biceps while either standing or sitting place handle bars seven (54) and eight (60) across the abdominal area. Reach across and grasp with palms up and fingers curled around handle bars three (16) and four (20). The action of pulling handle bars three (16) and four (20) inward toward the chest causes the two I section sub-assemblies to move relative to each other stretching the resistance bands, thus exercising the biceps.

An alternative bicep exercise is performed by placing handle bar seven (54) or eight (60) on a vertical line between the chest and the shoulder. The user reaches across the body and grips either handle bar seven (54) or eight (60). Grip handle bar three (16) or four (20) using the hand which is on the side as the biceps to be exercised. By pulling handle three (16) or four (20) toward the body the elastic members are stretched as the I shaped inner handle section moves away for the resistance bands attachment point of the I shaped long handle section. Thus providing resistance to exercise the biceps.

The inner thigh exercise is accomplished in a sitting position. Set down with the feet together and legs apart. Then place handles bars six (36) and eight (60) or handle bars five (30) and seven (54) between the legs and squeeze the legs together. Moving either handle bars six (36) and eight (60) together or moving handle bars five and seven (54) together causes the inner handle section to move away from the resistance band attachment point on the I shaped long handle section. This relative movement causes the resistance bands to stretch providing exercise to the inner thighs.

Outer Thigh Exercise is accomplished in a sitting position. Set down with the feet together and the legs partially opened. Place handle bar four (20) between the legs making sure that handle bar six (36) and handle bar two (46) are on the outside of the legs. Grasp handle bars one (42) and five (30) to provide additional support and stability to the exercise device. Then force the legs open. This causes relative movement between the inner shaped section and the resistance band attachment point on the I shaped long handle section providing resistance to exercise the outer thighs.

The Triceps can be exercised by sitting and placing handle bars five (30) and six (36) on top of the legs above the thighs and handle bars three (16) and four (20) below the thigh muscles of the legs. With palms down grab handle bars seven (54) and eight (60), then press down keeping both arms extended. This causes the I shaped long handle section to slide through the I shaped inner handle section which is held rigidly by the thighs. This motion increases the distance between the attachment points of the resistance bands. The resistance bands stretch and the Triceps are exercised.

In a similar manner abdominal crunches can be performed by positioning the exercise device as described above. To complete the position for abdominal crunches the user then bends at the waist and positions handle bars seven (54) and eight (60) across the sternum. As the user continues bending the chest forces the I shaped long handle section to slide through the I shaped inner handle section which is held rigidly by the thighs. This motion increases the distance between the attachment points of the resistance bands and provides the user with a exercise machine for abdominal crunches.

The Hamstring and Buttock muscles can be exercised by placing handles one (42) and two (46) on the front side of a chair. Then the ankles can be placed between handle five (30) and six (36) and three (16) and four (18). The user then exerts force from his legs to move handles three (16) and four (18) closer to handles seven (54) and eight (60). This places the elastic bands in tension. They resists the muscular efforts of the user resulting in a beneficial exercise for the Hamstring and Buttock muscles.

The Wrist and Forearms can be exercised by grasping handles bars five (30) and seven (54) or handle bars six (36) and eight (60) with the arms partially extended and then pushing the hands together.

The Shoulders can be exercised in a sitting position by placing handle bars three (16) and four (20) on top of the thighs and handle bars five (30) and six (36) below the thighs. Grasp handle bars one (42) and two (46) with palms down and pull toward the chin in a rowing motion. The user with the device in the same position now grasps handle bars one (42) and two (46) with palms up and rotates the forearms toward the chin. In this configuration the biceps are exercised.

The Triceps and Deltoids can be exercised from the standing position by placing handle bar three (16) or four (20) between the thighs. Handle bars one (42) or two (46) and five (30) or six (36) are positioned on the outside of the legs. Handle bars four (20) and six (36) can be used for additional support to the exercise device. To exercise the triceps and deltoids bend slightly from the upright position and grip bars one (42) and two (46). The user then pulls handle bars one (42) and two (46) outward away from the leg. The I shaped inner handle section is held stationary the I shaped long section slides through the inner handle section. The resistance bands are stretched. In a similar fashion handle bars five (30) or six (36) can be positioned between the legs. In this configuration the exercise is made easier to perform.

A special exercise for Bow Hunters is performed by grasping handle bars five (30) or six (36) and extending the arm straight in front of the body. Then with the outer hand grasp handles one (42) or two (46) and pull backwards toward the shoulder. This provides a motion similar to drawing a bow. Since the accuracy attained in archery is partially depended upon the steadiness of the archers drawing and holding the bowstring this exercise can be very beneficial to those engaged in the sport.

The calves can be exercised while sitting down. Handle bars seven (54) and eight (60) rest on the floor. The user grasps handle bars one (42) and two (46) and places his feet on handle bars five (30) and six (36). When the user forces handle bars five (30) and six (36) downward the two I sections change relative position and the resistance bands are stretched exercising the calves.

The Abdominal Group can be exercised by laying on the floor and placing handle bars seven (54) and eight (60) on the chest. Position handle bars three (16) and four (20) on the top of the thighs. Compress the body to hold the exercise device between the chest and the thighs. Continue moving the chest toward the thighs. The I shaped long handle slides through the I shaped inner handle held by the thighs. The resistance bands stretch and the Abdominal Group is exercised.

CONCLUSION

While the above description contains items that are specific these should not be construed as limitations on the claims, but rather as exemplification of the one preferred embodiment. Many other variations are possible. The scope of this invention should be determined by the attached claims and their legal equivalents and not by the embodiments illustrated.

What is claimed is:

1. A portable exercise device for use by a human comprising:

a. first elongated member having two ends and containing an entrance hole and an exit hole and having additional elongated members attached at their mid sections perpendicular to the first elongated member, and b. a second elongated member having two ends and having additional elongated members attached at their mid sections perpendicular to the second elongated member, and c. said second elongated member extending into said entrance hole, through, and past, said exit hole in said first elongated member, and d. a means for resistance having a first end and a second end, and e. two means of attachment having the first end of said means for resistance attached to said first elongated member and the second end of said means for resistance attached to said second elongated member, and f. whereby an exercise device entirely dependent on resistance from a means for resistance is created where a human being can vary his/her choice of elongated members for gripping, and depending on this choice, the exerciser can experience resistance from stretching said means for resistance when said elongated members are moved apart thereby exercising muscle groups designed for extension of the human body, and also a human can experience resistance from stretching said means for resistance by pushing different elongated members together thereby exercising different muscle groups designed for contraction of the human body.

2. A portable exercise device for use by a human comprising:

a. a first elongated member having two ends and at each of said two ends having two additional elongated members attached at their mid sections perpendicular to said first elongate member and said first elongate member containing an entrance hole and an exit hole therethrough, and b. a second elongated member having two ends and said second elongated member extending into said entrance hole and out said exit hole in said first elongated member, and c. said second elongated member at each of its said two ends having two additional elongated members attached at their mid sections perpendicular to said second elongated member where first elongated member can partially rotate and substantially move transversely along said second elongated member, and d. a means for resistance having a first end and a second end, and e. two means of attachment having said first end of said means for resistance attached to said first elongated member and said second end of said means for resistance attached to said second elongated member where said first elongated member is biased by said means for resistance toward said means of attachment on said second elongated member.

3. A portable exercise device for use by a human comprising:

a. a first elongated member having two ends and having additional elongated members attached at their mid sections perpendicular to said first elongated member, and said first elongate member containing an entrance hole and an exit hole therethrough, and b. a second elongated member having two ends and having additional elongated members attached at their mid sections to said ends of said second elongated member and said second elongated member extending into said entrance hole and out said exit hole in said first elongated member where said first elongated member with its said attached additional elongated members is completely bounded by said additional elongated members attached to said second elongated member, and c. a means for resistance having a first end and a second end, and d. two means of attachment having the first end of said means for resistance attached to said first elongated member and the second end of said means for resistance is attached to said second elongated member, and e. whereby an exercise device entirely dependent on resistance from stretching said means for resistance is created where a human being can vary his/her choice additional elongated members experiencing resistance when pushing additional elongated members together and when pulling other additional elongated members apart.

* * * * *